US006105501A

United States Patent [19]

Phillips et al.

[11] Patent Number: 6,105,501

[45] Date of Patent: Aug. 22, 2000

[54] HIGH RESOLUTION LITHOGRAPHIC PRINTING PLATE SUITABLE FOR IMAGING WITH LASER-DISCHARGE ARTICLE AND METHOD

[75] Inventors: Roger W. Phillips; Thomas Mayer, both of Santa Rosa, Calif.

[73] Assignee: Flex Products, Inc., Santa Rosa, Calif.

[21] Appl. No.: 09/095,033

[22] Filed: Jun. 10, 1998

[51] Int. Cl.[7] ..... B41N 1/14

[52] U.S. Cl. ..... 101/457; 101/462; 101/467

[58] Field of Search ..... 101/453, 454, 101/457, 460, 462, 463.1, 465–467

[56] References Cited

U.S. PATENT DOCUMENTS

| | | | |
|---|---|---|---|
| 3,929,481 | 12/1975 | Kubotera et al. | 430/302 |
| 4,238,560 | 12/1980 | Nakamura et al. | 101/454 |
| 4,842,893 | 6/1989 | Yializis et al. | 427/44 |
| 4,954,371 | 9/1990 | Yializis | 427/44 |
| 5,351,617 | 10/1994 | Williams et al. | 101/467 |
| 5,353,705 | 10/1994 | Lewis et al. | 101/453 |
| 5,379,698 | 1/1995 | Nowak et al. | 101/454 |
| 5,691,063 | 11/1997 | Davis et al. | 101/463.1 |
| 5,783,364 | 7/1998 | Ellis et al. | 101/467 |
| B1 5,339,737 | 6/1997 | Lewis et al. | 101/454 |

FOREIGN PATENT DOCUMENTS 573092 12/1993 European Pat. Off. .

OTHER PUBLICATIONS

Research Disclosure, Apr. 1980, 19201, "Method and material for the production of a dry planographic printing plate", p. 131, Leenders et al.

A. Yializis, R. Ellwanger and A. Boufelfel, "Superior Polymer Webs via in situ Surface Functionalization," Society of Vacuum Coaters, 505/856–7188, 39th Annual Technical Conference Proceedings, (1996), pp. 384–391, ISSN 0737–5921.

*Primary Examiner*—Stephen R. Funk

*Attorney, Agent, or Firm*—Workman, Nydegger & Seeley

[57] ABSTRACT

The present invention is directed to lithographic printing plates that are suitable for imaging by laser discharge using laser ablation. The lithographic printing plates according to the present invention comprise a vacuum deposited polymeric layer comprising polyvinylpyrrolidone having a thickness of up to about 6000 Angstroms, an absorbing layer underlying the first layer that absorbs infrared radiation and has a thickness in a range between about 100 and about 500 Angstroms, and a substrate underlying the absorbing layer. The polymeric layer and the substrate exhibit different affinities for at least one printing liquid selected from the group consisting of ink and an adhesive fluid for ink.

38 Claims, 3 Drawing Sheets

HIGH RESOLUTION LITHOGRAPHIC PRINTING PLATE SUITABLE FOR IMAGING WITH LASER-DISCHARGE ARTICLE AND METHOD

BACKGROUND OF THE INVENTION

1. The Field of the Invention

The present invention is directed to high resolution lithographic printing plates and methods for preparing lithographic printing plates. In particular, the present invention is directed to lithographic printing plates that are suitable for imaging with laser discharge.

2. Relevant Technology

Off-set lithography is a well known method of introducing a printed image onto a recording medium using ink-accepting "oleophilic" and ink-repellent "oleophobic" surface areas. In general, off-set lithography can be performed using dry plate printing or wet plate printing. In dry plate printing, the printing plate comprises materials having oleophilic surface areas and oleophobic surface areas. Alternatively, in wet plate printing, the plate comprises materials having hydrophilic surface areas and oleophilic surface areas. An adhesive fluid (also referred to herein as "fountain solution" or "dampening solution")is applied to the wet printing plate to provide ink repellency (i.e., to make the layer oleophobic) to the hydrophilic surface area.

In off-set lithography, ink is applied to the printing plate. The ink is then drawn to the oleophilic areas of the plate and subsequently transferred to a compliant intermediate surface known as a blanket cylinder which, in turn, applies the image to a recording medium.

Off-set lithography printing plates have traditionally been produced photographically. Photographic plate making processes generally use a photographic negative to form an image on a photosensitive layer that is subjected to numerous other chemical steps (depending on the specific photographic process used, or whether a wet plate or a dry plate is formed) to form an image on the printing plate. Although lithographic printing plates can be formed using photographic plate making processes, these processes tend to be tedious, time consuming, environmentally detrimental and require facilities and equipment adequate to support the necessary chemical steps.

More recently, in an attempt to overcome the problems associated with photographic plate processes, electronic plate making processes using electromagnetic radiation pulses that can be produced by lasers have been used. Because of the ready availability of laser equipment and their amenability to digital control, significant effort has been devoted to the development of laser-based imaging systems. For example, lasers have been used to transfer thermal-transfer materials onto a suitable substrate. In the thermal-transfer process, the material transferred has a different affinity for a fountain solution and/or ink than the acceptor substrate material resulting in a printing plate having an oleophilic surface area and an oleophobic surface area (or hydrophilic and oleophilic surface areas, depending on whether a wet or dry plate is formed).

Unfortunately, due to the limited amount of material that can be effectively transferred to the acceptor substrate with acceptable adhesion using a thermal-transfer process, printing plates produced with transfer-type systems lack durability. Furthermore, because the transfer process involves melting and resolidification of the transfer material, the resolution and quality of the image produced by the printing plate is often unsatisfactory. In addition, inconsistent transfer from the donor sheet to the acceptor substrate is also often a problem.

U.S. Pat. No. 5,339,737, issued to Lewis et al. ("Lewis") provides a lithographic printing plate characterized as enabling imaging using laser-discharge. In Lewis, an image is formed on a printing plate using laser ablation technology. Referring to FIG. 1A, the printing plate 10 generally comprises a substrate 16 having a first layer 14 on the substrate that is characterized by efficient absorption of infrared ("IR")radiation. A second layer 12, described as being preferably polyvinyl alcohol, is located on first layer 14 The substrate 16 and the second layer 12 have different affinities for ink (dry-plate construction) or an adhesive fluid for ink (wet-plate construction).

Upon actuation of a properly positioned laser, laser radiation is absorbed by first layer 14, causing ablation of the first layer. Ablation of the first layer 14 disrupts the overlying second layer 12. A representation of an ablated first layer 14 and a loosened laser ejecta portion 17 of first layer 14 and second layer 12 is shown in FIG. 1B. A subsequent cleaning step is typically required to remove laser ejecta portion 17. The result is an image spot 18 (shown in FIG. 1C as being filled with ink 20) extending down to the substrate layer 16 whose affinity for the ink or ink-adhesive fluid differs from that of the second layer 12.

As used herein, the term "image spot" is defined as the image formed in the printing plate by a laser. Numerous image spots are combined to form an image or an image area. Other patents disclosing laser ablation imaging techniques to form lithographic printing plates include U.S. Pat. Nos. 5,351,617, 5,353,705 and 5,379,698.

Although the use of laser ablation techniques to form images on printing plates is a significant advancement in the imaging of printing plates, this technique still has its drawbacks. One problem with lithographic printing plates which are imaged using typical laser ablation technology, such as disclosed in Lewis, is the dramatic need for post ablative cleaning.

According to Lewis, the topmost layer often remains on the plate after the ablation process as a disrupted, but unremoved layer. In addition, ablation of the absorbing layer creates debris trapped beneath the top layer. In order to remove the debris and topmost layer, the topmost layer must be removed in an additional post-ablative cleaning step. This is disclosed as being accomplished through the use of a mechanical contact cleaning device such as a rotating brush.

Thus, there remains a need in the art for a printing plate that does not require post-ablative cleaning and wherein a high resolution image over large areas can be formed in the printing plate using laser ablation.

SUMMARY AND OBJECTS OF THE INVENTION

It is therefore an object of the present invention to provide an improved printing plate and an improved method for imaging a printing plate.

It is also an object of the present invention to provide an improved lithographic printing plate that is imaged using laser ablation techniques.

It is another object of the present invention to provide a lithographic printing plate that has high resolution over a large area.

It is a further object of the present invention to provide a lithographic printing plate that is durable.

It is also an object of the present invention to produce lithographic printing plates in a defect free vacuum coating process.

It is also an object of the present invention to decrease the capillary action of the ink on a printing plate to allow smaller laser image spots resulting in improved resolution.

It is an additional object of the present invention to improve resolution while increasing the durability of the printing plate.

It is a further object of the invention to provide lithographic printing plates that do not need cleaning after laser ablation to remove adhering laser ejecta.

To achieve the foregoing objects, and in accordance with the invention as embodied and broadly described herein, the present invention is directed to lithographic printing plates that are directly imageable by laser discharge using laser ablation techniques. Lithographic printing plates in accordance with the present invention comprise a polymeric layer having a thickness of up to about 6000 Å, an absorbing layer underlying the polymeric layer that absorbs infrared (or near infrared) radiation and has a thickness in a range between about 100 and about 500 Å, and a substrate underlying the absorbing layer. The polymeric layer and the substrate exhibit different affinities for at least one printing liquid selected from the group consisting of ink and an adhesive fluid for ink. At least a portion of the substrate is volatile during the imaging process.

The plates in the present invention do not necessitate cleaning thereof after imaging to remove occluded imaging layer debris as with typical designs. Instead, in accordance with the present invention, and contrary to conventional knowledge, it has been discovered that images can be formed on lithographic printing plates comprising a thin polymeric layer (e.g., up to about 6000 Å, and as thin as about 400 Å, preferably about 1000 Å) using laser ablation without the need of a cleaning step.

The printing plate of the present invention has minimal defects if any from contamination. Rather than being required to perform a separate cleaning step, laser ablated material blows cleanly away from the ablated plates during the ablation process as a result of microexplosions under the absorption layer. Consequently, no materials adhere to the pixel areas.

Furthermore, because the image spot formed in the printing plate does not have a significant depth compared to typical designs, small, precise image spots can be used to form an image, resulting in prints having high resolution. Surprisingly, even though the polymeric layer may have a thickness less than about 1000 Å, by cross-linking the polymeric layer, lithographic printing plates in accordance with the present invention, exhibit excellent long term durability often providing as many as 70,000 prints per plate.

In one preferred embodiment of the present invention, the lithographic printing plate comprises a polyvinylpyrrolidone layer having a thickness of about 1000 Å; a titanium absorption layer underlying the polyvinylpyrrolidone layer that absorbs infrared (IR) radiation and has a thickness of about 200 Å; and an oleophilic polyester substrate underlying the absorption layer, wherein at least a portion of the substrate is volatile when exposed to heat generated when the write laser is on. When the hydrophilic polyvinylpyrrolidone is used as the outermost polymeric layer, treatment of the hydrophilic polyvinylpyrrolidone to cross link the polyvinylpyrrolidone chains can increase the durability of the lithographic printing plate.

As used herein, throughout this specification and the appended claims, the terms "cross-linking" "cross-linked" or "cross-link" are defined as the attachment of two chains of polymer molecules by bridges composed either of an element, group, or a compound.

It has been discovered that when hydrophilic polymers are evaporated and exposed to energetic ions, such as Ar+, $N_2$+ and even $O_2$+, the hydrophilic nature of the non-imaged areas is maintained during extended printing. By way of example, these ions can be generated using respective plasmas selected from the group consisting of argon gas plasma, nitrogen gas plasma, and oxygen gas plasma, respectively. This process for forming the hydrophilic polymers eliminates fingerprints from handling. The printing plate of the present invention also features high resolution printing and is highly durable.

In typical printing plates, on the other hand, in order to be sufficiently durable for practical usage, the top layer must have a minimum thickness which is significantly thicker than the top layer of the present invention. In U.S. Pat. No. 5,339,737, for example, the preferred hydrophilic outer layer 12 (see FIGS. 1A–1C) is polyvinyl alcohol. To be sufficiently durable for practical usage, the polyvinyl alcohol layer of the structure disclosed in the '737 patent must have a minimum thickness of around 8000 Å. Typical thicknesses are about 2 $\mu$m or 20,000 Å. A hydrophilic layer having a coating thickness of about 1 g/m$^2$ (≈8,000 Å using density of about 1.2 to about 1.3 $\frac{gm}{cc}$ for polyvinyl alcohol), as disclosed in Lewis, requires a deep image spot 18 to reach the oleophilic layer 16 (the substrate).

This thick layer causes a variety of problems, such as the material and application expense of such a thick layer; postablative cleaning of ablated material; a loss in resolution due to ink retention in the deep recessed pixels and subsequent ink spreading from the squeegeeing effect of printing, and a decrease in laser sensitivity due to a thick overburdened top layer over the ablative layer.

Ink retention within typical printing plates is caused at least in part by capillary action. Capillary action is the action by which the surface of a liquid, in this case ink 20, contacts the sidewalls of printing plate layers 12 and 14 and can be elevated or depressed, because of the relative attraction of the molecules of liquid for each other and for those of the surrounding walls. For liquid 20 to be transferred from printing plate 10 to a recording material, the image spot must have less capillary action than the wetting action of the blanket to provide an adequate amount of ink to the recording medium to form an acceptable image. Otherwise, the capillary action caused by the ablated image spot prevents a sufficient amount of ink from being transferred from the printing plate.

The depth of the image spot 18 in typical plates results in high capillary forces, causing at least a portion of the ink to hold up in the printing plate. This causes small features not to print, fail to completely print, or fail to print with sharp features (high resolution). To sufficiently overcome capillary forces and provide an adequate amount of ink to a recording medium, it is often necessary to form wider image spots and, in doing so, sacrifice resolution. For example, as the size of the image spot increases, the resolution of the printed image decreases.

Another problem with typical printing plates with thick coatings is that the layers often vary in thickness, resulting in a non-uniform focal depth of the imaging laser. These problems associated with typical thick top layers are further compounded by lower sensitivity of typical printing plates to electromagnetic radiation, resulting in non-uniform areas of ablation or even no ablation in some regions that require ablation, and often requiring higher planarity of the plate or, alternatively, the use of higher power lasers. If these requirements are not met, the plate will result in non-uniform areas of ablation, or even no ablation in some regions that require ablation.

The significantly thinner top layer of the present invention overcomes these difficulties. These and other objects and features of the present invention will become more fully apparent from the following description and appended claims, or may be learned by the practice of the invention as set forth hereinafter.

BRIEF DESCRIPTION OF THE DRAWINGS

In order to show the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1A:
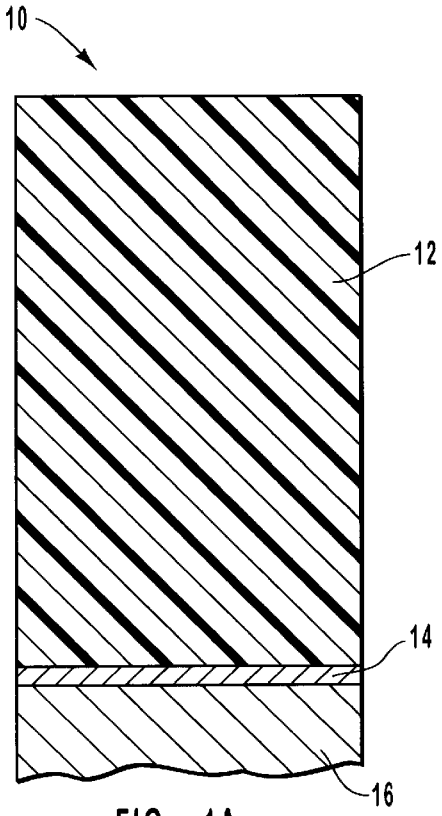
FIG. 1A (PRIOR ART)
FIG. 1A is an enlarged cross-sectional view of a lithographic printing plate in accordance with the prior art.
Figure 1B:
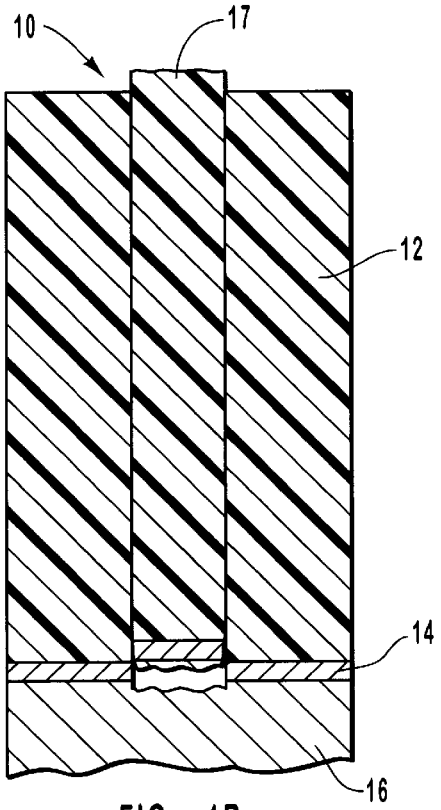
FIG. 1B (PRIOR ART)
FIG. 1B is a representation of the lithographic printing plate of FIG. 1A which has been ablated with a laser, forming a loosened laser ejecta.
Figure 1C:
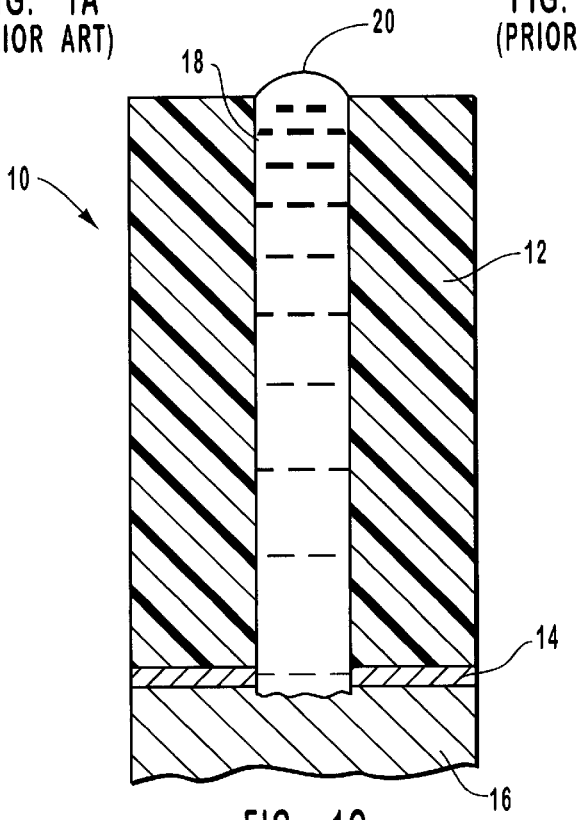
FIG. 1C (PRIOR ART)
FIG. 1C provides a view of the lithographic printing plate of FIG. 1B with the laser ejecta removed, illustrating ink deposited into an image spot.
Figure 2A:
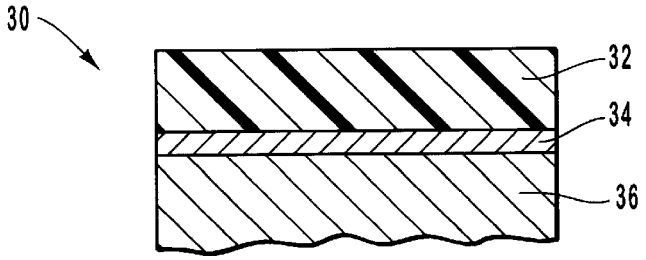
FIG. 2A is an enlarged cross-sectional view showing a lithographic printing plate in accordance with the present invention having two layers on a substrate.

As illustrated in FIG. 2A, a lithographic printing plate 30 within the scope of the present invention, comprises a polymeric layer 32, an absorbing layer 34 underlying the polymeric layer that absorbs infrared radiation, and a substrate 36 underlying the absorbing layer. The polymeric layer 32 and the substrate 36 exhibit different affinities for at least one printing liquid selected from the group consisting of ink and an adhesive fluid for ink. For instance, if the polymeric layer has an affinity for the fountain solution (i.e., the polymeric layer is hydrophilic) then the substrate is hydrophobic and oleophilic. Alternatively, with dry plate construction, if the polymeric layer is oleophobic (i.e., repels ink), the substrate layer is oleophilic (i.e., has an affinity for ink). In general, when used in off-set lithography printing processes, polymeric layer 32 typically does not have an affinity for ink, so the polymeric layer is usually oleophobic (dry plate construction) or hydrophilic (wet plate construction).

In a wet plate construction embodiment of the present invention, the polymeric layer is preferably a hydrophilic material. Examples of useful hydrophilic materials include, but are not limited to, materials such as poly (vinylpyrrolidone), poly(2-hydroxyethylmethacrylate), polyethylene glycol (PEG), polyethylene oxide (PEO), ethylene glycol dimethacrylate (EGDM), a copolymer of vinyl pyrrolidone and an acrylate, a copolymer of acrylic acid ($C_3H_4O_2$) and an acrylate, a copolymer of acrylic acid, vinyl pyrrolidone and an acrylate, a copolymer of trimethanoltriacrylate and vinyl pyrrolidone, and mixtures and derivatives thereof.

In each of the copolymer embodiments discussed herein, the acrylate may comprise a monoacrylate, a diacrylate, a triacrylate, or mixtures or derivatives thereof. Thus, examples of copolymers of vinyl pyrrolidone and an acrylate include, without limitation, poly(acrylate-vinylpyrrolidone), poly(diacrylate-vinylpyrrolidone), poly(triacrylate-vinylpyrrolidone), and mixtures and derivatives thereof.

Figure 2B:
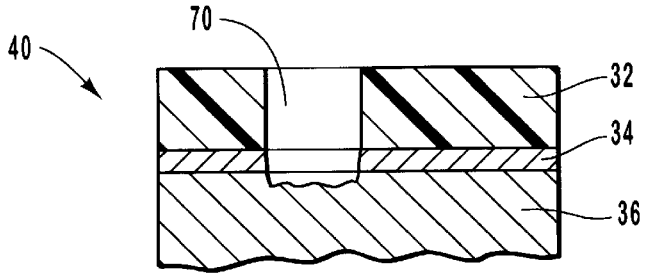
FIG. 2B is an enlarged cross-sectional view illustrating a lithographic printing plate imageable in accordance with the present invention having two layers on a substrate with an image spot formed therein.
Figure 2C:
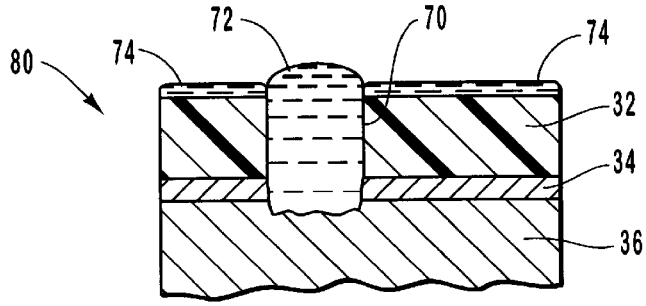
FIG. 2C is an enlarged cross-sectional view of a lithographic printing plate having a wet-plate construction and having an image spot formed therein, the image spot having ink deposited therein.

In use, after an image is formed on the printing plate (FIG. 2B), an adhesive fluid for ink is added to printing plate 80 (FIG. 2C). The adhesive fluid 74 is drawn to the hydrophilic polymeric layer 32 and is repelled by the hydrophobic, oleophilic substrate 36. Ink applied to the printing plate then adheres to the oleophilic substrate 36 and is repelled by the adhesive fluid on the polymeric layer 32. The ink 72 present in the image spot 70 formed by laser ablation is then transferred by off-set lithography to a recording medium to form an image.

Figure 2D:
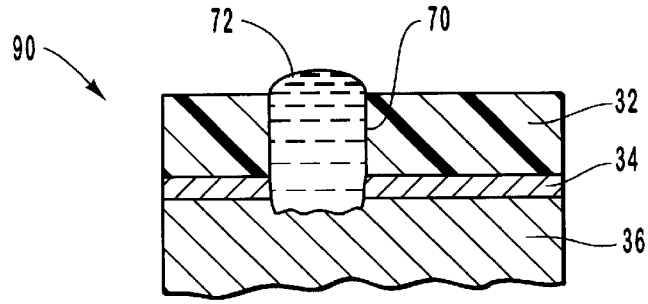
FIG. 2D is an enlarged cross-sectional view of a lithographic printing plate having a dry-plate construction and having an image spot formed therein, the image spot having ink deposited therein.

In a dry plate construction embodiment of the present invention, the polymeric layer 32 is preferably an oleophobic material, such as a fluorinated acrylate, a fluorinated methacrylate, a perfluoroalkyl methacrylate, tetrafluoroethylene (PTFE) (commonly sold under the trademark TEFLON), fluorinated ethylenepropylene (FEP), other fluoro-polymer based materials, organosiloxane, silicone such as epoxysiloxanes or epoxysilicones, or mixtures or derivatives thereof In use, after an image spot 70 is formed on the printing plate 90 (FIG. 2D), ink is applied to the printing plate. The ink applied to the printing plate is repelled by the oleophobic polymeric layer 32 and adheres to the oleophilic substrate 36. The image is then transferred by off-set lithography to an appropriate recording material to form an image.

In both the wet plate and dry plate scenarios, polymeric layer 32 according to the present invention has a thickness up to about 6000 Å, preferably in a range between about 200 Å to about 2000 Å, more preferably from about 400 Å to about 1500 Å, and most preferably about 1000 Å. The thinness of the outermost polymeric layer 32 allows the underlying absorbing layer 34 to completely ablate the polymeric layer 32 eliminating any need for post ablative cleaning. The energy of the microexplosion is sufficient to disrupt laser ablated material cleanly.

While a variety of different manufacturing techniques, such as wet chemistry techniques, are available to form layer 32, polymeric layer 32 is preferably formed using vacuum evaporation. Vacuum evaporation permits formation of layer 32 with submicron thicknesses. In addition to forming a thin layer, the vacuum evaporation process allows the formation of a polymeric layer having a thickness which is more uniform than a wet chemical process, providing superior print quality. Furthermore, the vacuum evaporation process produces a film which is free from contamination, e.g. particulate, and defects, e.g. bubbles or different densities within layer 32.

Polymeric layer 32 may be evaporated using a resistance heated source or evaporated through a piezoelectric device. In one embodiment, evaporation is performed using flash evaporation of monomeric fluids technology, such as described in U.S Pat. No. 4,842,893, entitled "High Speed Process for Coating Substrates," U.S. Pat. No. 4,954,371, entitled "Flash Evaporation of Monomer Fluids," and "Superior Polymer Webs via in situ Surface Functionalization," Society of Vacuum Coaters, 505/856-7188, 39th Annual Technical Conference Proceedings, (1996), p.384–391, ISSN 0737-5921, each of which are incorporated herein in their entirety by reference.

Despite the thinness of the polymeric layer 32, the printing plates according to the present invention are surprisingly durable, often capable of delivering about 70,000 printing impressions. To deliver this many printing impressions, the printing plate and especially the outermost polymeric layer must be extremely durable.

To increase the strength and durability of the polymeric layer, the polymeric material used in the present invention is cross-linked. The polymers used in the present invention can be cross-linked using any technique commonly known in the art, such as electron-beam or U.V. curing. In one embodiment, a photoinitiator is added when U.V. curing is desired.

The strength and the durability of the polymeric layer is largely dependent on the extent to which the polymer is cross-linked to itself and other polymers. For example, if the polymer is highly cross-linked, the polymeric layer will have a high molecular weight which increases durability. The more durable the polymeric layer, the more printing impressions the printing plate can perform.

It is understood by one of ordinary skill in the art in view of the present invention that the degree the polymeric layer 32 is cross-linked can vary widely depending on the desired qualities of the polymeric layer and the qualities of the printing plate in general. It is further understood in view of the present invention that the cross-linking may also affect the qualities of the other layers in the printing plate and, consequently, may require alterations in the thickness or other qualities of the other layers in the printing plate.

One embodiment of the cross-linked polymeric layer comprises a copolymer of vinyl pyrrolidone and an acrylate. Another embodiment of the cross-linked polymeric layer comprises a copolymer of acrylic acid ($C_3H_4O_2$) and an acrylate. Yet another embodiment of the cross-linked polymeric layer comprises a copolymer of acrylic acid, vinyl pyrrolidone and an acrylate.

In one embodiment, the polymeric layer copolymer comprises an acrylate in the range of about 0.5% to about 20% by weight of the copolymer with the remainder of the copolymer comprising acrylic acid and/or vinyl pyrrolidone. In another embodiment, the copolymer comprises an acrylate in the range of about 1% to about 6% by weight of the copolymer with the remainder of the copolymer comprising acrylic acid and/or vinyl pyrrolidone. In yet another embodiment, the copolymer comprises an acrylate in the range of about 3% by weight of the copolymer, with the remainder of the copolymer comprising acrylic acid and/or vinyl pyrrolidone.

As discussed above, the acrylate used may be a monoacrylate, a diacrylate or a triacrylate. Other examples of such copolymers are also provided above. Alternatively, top layer 32 may be a cross-linked silicone layer or a perfluorinated acrylate.

It has also been discovered that when hydrophilic polymers are evaporated and exposed to energetic ions, such as Ar+, $N_2$+ and even $O_2$+, the hydrophilic nature of the non-imaged areas is maintained during extended printing. These ions may be generated from an energetic ion source, such as the appropriate gas plasma.

The absorbing layer 34, positioned underneath the polymeric layer, absorbs radiation in the infrared, or near-infrared region. As used herein, the term "infrared" includes the infrared and near-infrared regions of the spectrum. When exposed to a laser that emits infrared radiation, the absorbing layer absorbs the energy emitted from the laser and generates heat, facilitating laser ablation. Examples of suitable absorbing layers include, but are not limited to titanium, a polymeric coating that absorbs infrared radiation, or a polymeric coating having a material that absorbs infrared radiation, such as titanium, dispersed or dissolved therein.

The thickness of the absorbing layer is important because the absorption of the absorbing layer and, consequently, the heat generated is directly related to the thickness of the absorbing layer and its absorption coefficient. In laser ablation techniques, it is, therefore, important for the absorbing layer to have a thickness sufficiently thick to produce an adequate amount of heat to cause ablation. In the present invention, the absorbing layer has a thickness in a range between about 100 to about 500 Å, and preferably, about 200 Å.

Substrate 36 is preferably a strong, stable and flexible material, such as paper, aluminum foil, aluminum plate, copper foil, copper plate, polycarbonate, polyester (such as polyethylene terephthalate and polyethylene naphthanate), polyimides, polyvinyl chloride, or mixtures or derivatives thereof. Although the substrate can have a wide range of thicknesses, the substrate typically has a thickness in a range between about 1 to about 12 mils. In oneembodiment, the thickness is about 25 $\mu$m to about 310 $\mu$m.

Depending on its use, substrate 36 may be either opaque or transparent. In circumstances where the laser is positioned on the substrate side of the printing plate so that the laser radiation travels through the substrate to reach the absorbing layer, the substrate is transparent to laser radiation.

Substrates in accordance with the present invention exhibit affinities for at least one printing liquid selected from the group consisting of ink and an adhesive fluid for ink, wherein the substrate's affinity differs from the affinity of the polymeric layer, As mentioned above, for example, if a substrate is oleophilic, then the polymeric layer is oleophobic. Likewise, if the polymeric layer is hydrophilic, the substrate is oleophilic.

In a preferred embodiment, at least a portion of the substrate is volatile when exposed to heat. Referring to FIG.

2B, showing a printing plate 40 it is believed that volatility of at least a portion of the substrate enhances ablation of absorbing layer 34 and polymeric layer 32 in forming an image spot 70. Substrate 36 is exposed to heat generated when absorbing layer 34 absorbs radiation emitted by a laser. When substrate 36 contains volatile components, the substantial amount of heat generated by the absorbing layer causes a portion of the volatile substrate to volatilize, forming a gas bubble and completely ablating the absorbing layer 34 and the polymeric layer 32.

Enhanced ablation resulting from the volatile substrate and the thin polymeric layer 32 alleviates the need to clean the printing plate subsequent to laser ablation and prior to use. Due to the thin overburden of top layer 32, the ablation image spots or pixels blow clean during the ablation process as a result of microexplosions under the absorbing layer. Even if trace microscopic materials are present, they are easily washed away when ink is applied to the plate.

Examples of substrates which are volatile include, but are not limited to, polycarbonate, polyester (such as polyethylene terephthalate and polyethylene naphthanate), polyimides, polyvinyl chloride, and mixtures and derivatives thereof.

In an alternative embodiment of a substrate, at least a portion of which is volatile when exposed to heat, the substrate may comprise (i) a volatile gas generating layer underlying the absorbing layer; and (ii) a material underlying the volatile layer.

Figure 3A:
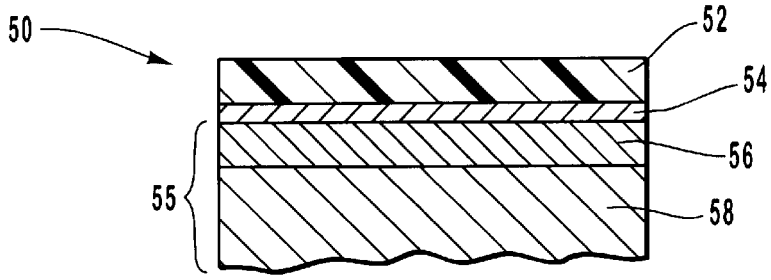
FIG. 3A is an enlarged cross-sectional view showing a lithographic printing plate in accordance with the present invention imageable by laser ablation having three layers on a substrate.

FIG. 3A illustrates an example of a printing plate 50 having a substrate 55 comprising a volatile layer 56 and an underlying material 58. As with other printing plates within the scope of the present invention, printing plate 50 comprises a polymeric layer 52 and an absorbing layer 54 underlying the polymeric layer The volatile layer 56 is preferably positioned underneath the absorbing layer 54 and above underlying material 58 so that the volatile layer is exposed to the heat generated when the absorbing layer absorbs laser radiation.

Figure 3B:
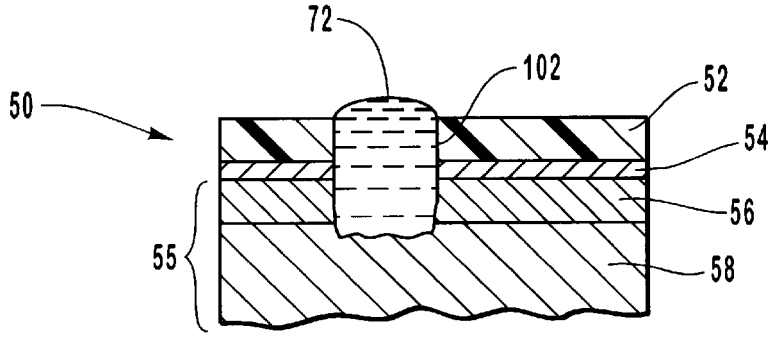
FIG. 3B is an enlarged cross-sectional view of a lithographic printing plate in accordance with the present invention having three layers on a substrate and having an image spot formed in the printing plate, the image spot having ink deposited therein.

The volatile layer 56 enhances the laser ablation process by readily vaporizing upon exposure to the heat generated by absorbing layer 54, forming a sufficient amount of gas to ablate absorbing layer 54 and polymeric layer 52 and form an image spot 102 (shown in FIG. 3B as being filled with ink 72). Here again, by utilizing a volatile layer 56 in the ablation process, the layers above the volatile layer, i.e., layers 54 and 52, are thoroughly ablated, eliminating the need to clean printing plate 50 prior to use.

Underlying material 58 can be volatile or nonvolatile, but volatile layer 56 is particularly useful when a nonvolatile underlying material such as aluminum foil, aluminum plate, copper foil or copper plate is employed within underlying material 58. In another embodiment, underlying material 58 is a material such as paper, polycarbonate, polyester (such as polyethylene terephthalate and polyethylene naphthanate), polyimides, polyvinyl chloride, or mixtures or derivatives thereof.

Volatile layer 56 and the underlying material 58 thus collectively form one embodiment of a substrate 55. Underlying material 58 and polymeric layer 52 exhibit different affinities for at least one printing liquid selected from the group consisting of ink and an adhesive fluid for ink. In one embodiment, underlying material 58 is oleophilic.

Volatile layer 56 can comprise of any material that safely and completely volatilizes in response to heat, such as an organic coating layer capable of giving off gaseous components when heated. Volatile layer 56 preferably produces a gas bubble at temperatures less than about 300° C., and more preferably at temperatures less than about 250° C., to aid in the formation of an image spot.

Examples of volatile materials that can be used in the present invention within layer 56 include, but are not limited to polyethylene carbonate, polyvinylidene, polyester, polyvinyl chloride and polymers such as an acrylate containing a plasticizer having a low boiling point designed to decompose at low temperatures to produce a gas bubble sufficient to propel the layers above the volatile layer of the printing plate, and mixtures and derivatives thereof. Typical plasticizers include, without limitation, chlorinated paraffins, organo-phosphates, phthalic acid derivatives and glycol derivatives. Low molecular weight components arising from partially uncured or heat cured materials i.e., uncross-linked components, may also be employed. The volatile layer typically has a thickness between about 50 Å and about 2000 Å, and is preferably in the range between about 1000 Å and about 2000 Å when evaporated in a vacuum roll coater.

Deposition of the volatile layer can be accomplished by coating the substrate in either an air or vacuum roll coater, for example. The volatile layer may be evaporated onto the underlying substrate layer as described above with respect to polymeric layer 32, for example. U.V. or electron beam curing of the volatile layer is performed before exposing the film to deposition of absorbing layer 34. Alternatively, the volatile layer can be heat cured in an air roll coater.

In a liquid (wet chemical) roll coater, the thickness of the volatile layer is in a range between about 0.5 $\mu$m to about 5 $\mu$m and preferably in the range between about 1 $\mu$m to about 3 $\mu$m. In one embodiment, the wet chemistry applied volatile layer is preferably inherently oleophilic. This oleophilicity is desirable in the event ablation does not occur all the way to the oleophilic underlying material 58. Wet chemistry techniques may be employed using a microgravure coating machine, for example.

In a preferred method of imaging a lithographic printing plate, printing plates comprise a polyvinylpyrrolidone polymeric layer 32, a titanium absorbing layer 34 underlying the polymeric layer and a polyethylene terephthalate (PET) substrate 36 underlying the absorbing layer. At least a portion of the substrate is preferably volatile when exposed to heat so as to aid in the ablation of the polymeric layer and the absorbing layer. The absorbing layer preferably has a thickness between about 100 Angstroms and about 500 Angstroms so that a sufficient amount of heat is generated to cause volatilization of a portion of the substrate. The polymeric layer and the substrate exhibit different affinities for at least one printing liquid selected from the group consisting of ink and an adhesive fluid for ink, depending on whether a wet plate printing process or a dry plate printing process is performed.

In one embodiment, vinyl pyrrolidone is evaporated as a monomer in vacuum onto a moving web of titanium-coated polyester. The polyester is cooled against a rotating drum. Electron-beam curing of the deposited monomer in vacuum results in cross-linking of the monomer into a cross-linked polymer of poly(vinyl pyrrolidone).

In general, images are prepared using laser ablation techniques by irradiating the printing plate with a pulse of laser energy, typically from an infrared laser. The laser energy is absorbed by absorbing layer 34 causing heat to be generated in the absorbing layer. The heat generated induces a microexplosion in the material (layers 36 and 32) adjacent to the absorbing layer. The microexplosion ejects the absorbing layer 34 and the polymeric layer 32 resulting in a cavity referred to herein as an image spot. When the laser ablation process is performed with an X-Y micro-positioning plotter, the entire image of the printing plate can be digitally processed to form precise images.

To produce an image on the printing plate, at least one, and preferably more than one, gallium-arsenide model laser source is provided and positioned an appropriate distance from the printing plate. It is noted that the distance the laser is positioned from the printing plate is dependent on numerous factors, and it is appreciated by one of ordinary skill in view of the present invention what is an appropriate distance from the printing plate. The output of each laser is guided to focus on the absorbing layer 34. The output of the laser is moved relative to the printing plate to effect a scan. The movement of the laser beam relative to the printing plate can be performed using any known means in the art including, but not limited to an X-Y micro-positioning plotter or by infrared relecting optics. The image pattern is selectively exposed to the laser output during the course of the scan so as to remove the polymeric layer and the absorbing layer to produce an image on the printing plate.

Figure 4:
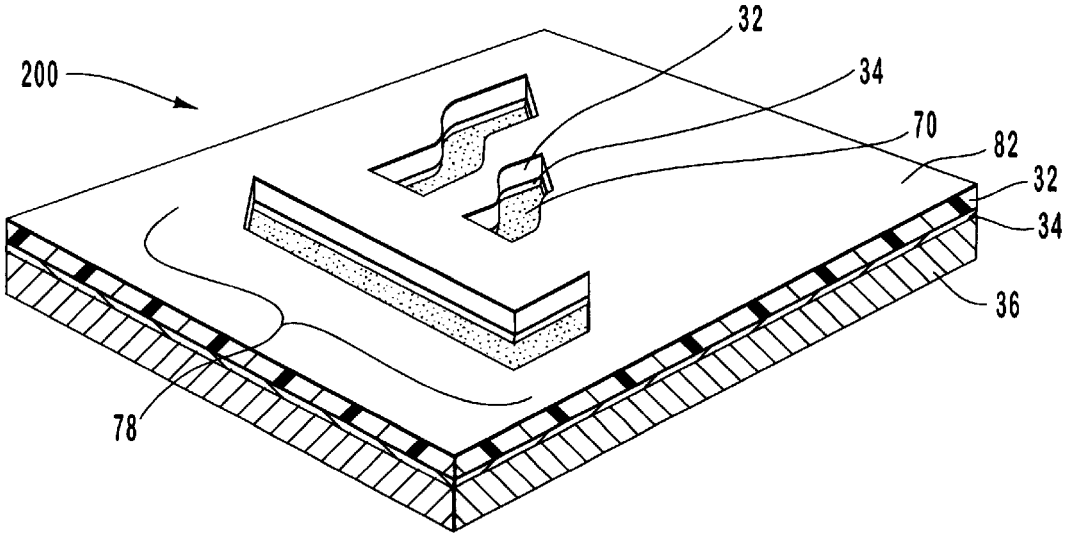
FIG. 4 is a perspective view of a printing plate in accordance with the present invention having an image formed therein.

An image 78 formed in a printing plate 200 in accordance with the present invention is illustrated in FIG. 4. An image according to the present invention is formed on printing plate 200 using at least one laser device that emits in the infrared or near-infrared region. As used herein, the terms "infrared region" and "near-infrared region are defined as imaging radiation whose $lambda_{max}(\lambda)$ lies between about 700 nm and about 1500 nm. Any suitable pulsed laser that emits radiation in the infrared region can be used in the present invention to form images using laser ablation on printing plates. In a preferred embodiment, the laser used to form images on the printing plates is a gallium-arsenide model. Suitable lasers and imaging systems are more thoroughly described in U.S. Pat. Nos. 5,339,737; 5,351,617; 5,353,705 and 5,379,698, which are herein incorporated by reference.

The size of the image spot, or the image resolution, can be varied in a number of ways, such as by varying the diameter of the laser beam. The laser pulse used must be of sufficient power and duration to produce useful ablation for imaging; however, there exists an upper limit in power levels and exposure times above which further useful, increased ablation is not achieved. Using excessive power can result in heat damage around and under the ablated spot.

Regardless of whether printing plate 200 comprises a wet plate construction or a dry plate construction, ink 72 adheres to the oleophilic substrate 36. Depending on whether wet plate printing or dry plate printing is performed, an ink or an adhesive fluid is applied to printing plate 200. If an adhesive fluid is applied to the printing plate, the adhesive fluid adheres to the surface of the polymeric layer and ink is then applied to the printing plate 200. The ink 72 applied to printing plate 200, adheres to the substrate which has been exposed by the laser ablation techniques. The image formed in the printing plate is then transferred to an appropriate recording medium using conventional off-set lithography techniques.

EXAMPLES

The following examples illustrate the formation of lithographic printing plates according to the present invention, the optical qualities of the lithographic printing plates, imaging of the lithographic printing plates and printing with the lithographic printing plates to form high quality printed images with no pre-cleaning of the lithographic printing plates prior to printing.

Example 1

1. Preparation of Printing Plate

A lithographic printing plate was prepared using a 10"× 18" sheet of 7 mil PET (ICI 453) as a substrate. The PET substrate was placed on a substrate holder in a dual rotation box vacuum coater. The chamber was then pumped down to $10^{-5}$ Torr before initiating the following sequential evaporations. First a titanium absorption layer was electron beam evaporated onto the substrate to a thickness of 200 Å. A polyvinylpyrrolidone (PVP) polymeric layer was then deposited using thermal evaporation to form a PVP layer having a thickness of 800 Å. The thicknesses of the PET absorption layer and the PVP polymeric layer were measured in-situ using calibrated quartz crystal monitors. An oxygen glow discharge was then applied for one minute to the surface of the deposited PVP to form a PVP surface that exhibited a water contact angle of approximately 10°, thus showing a high degree of hydrophilicity.

2. Optical Properties

The lithographic printing plate formed exhibited a 25% reflection, a 15% transmission and 60% absorption. These optical properties were measured on a Shimadzu spectrophotometer at 860 nm.

3. Imaging

Imaging of the printing plate was carried out by securing the lithographic printing plate formed above around a 6.8" diameter drum equipped with a laser scanning diode array. The laser beam was set at a 13 $\mu$s pulse focused to a 36 $\mu$m beam diameter at the surface of the lithographic printing plate. The image was formed using a laser pulse having an energy density/pulse of 540 mj/cm$^2$ before absorption (324 mj/cm$^2$ after absorption; 540 mj/cm×0.60). A digital laser test pattern was used for all lithographic printing plate examples. The laser sensitivity as judged by the number of mils off-focus was equal to +/−9 mils.

4. Printing

Printing using the lithographic printing plate was carried out using a Hamada 665 duplicator printing press. A SF-7212 OS Soya Super Intense Black ink was applied to the lithographic printing plate. The lithographic printing plate was used to transfer the image onto 60 lb smooth offset paper. The fountain solutions used contained 4 oz of SLM-OD (Silver Master Fountain from Mitsubishi Corporation) fountain solution, 4 oz of Universal fountain solution 306 (available from Hurst Graphics), 2 oz of Varn drier, and 118 oz tap water. A blue rubber (Day Accu.Dot compressible blanket) was used.

The image was printed from the PET/Ti/PVP lithographic printing plate as described above, using the press condition also described above to produce an image having good black and white areas and high print resolution with no prior cleaning of the plate surface. The alphabet in two point courier font printed with clear resolution with no smearing, drop-outs, or other defects.

Example 2

1. Preparation of the Printing Plate

A second sample lithographic printing plate identical to the printing plate described in Example 1 was prepared except the PVP polymeric layer was evaporated to a thickness of 1000 Å, and the substrate was 7 mil PET (ICI 329).

2. Optical Properties

The lithographic printing plate with a 2% total transmission, a 7.5% reflectance, and a 91.5% absorbance at 860 nm was prepared. The higher absorption exhibited by the second sample lithographic printing plate was believed to be due to the reflection of the transmitted beam off the white, semi-opaque, translucent substrate which resulted in a second pass through the optical stack.

3. Imaging

Imaging of the second sample lithographic printing plate was carried out using a process identical to the process described above in Example 1, in all respects except that a Graphics Arts Technical Foundation (FATF) digital test from (version 2.0) was used.

4. Printing

Using the same parameters as in Example 1, 11,000 prints were made using the second sample lithographic printing plate. The 11,000th print using the second sample lithographic printing plate showed one point font printing cleanly; and good blacks and whites were achieved. No pre-cleaning of the second sample lithographic printing plate was carried out prior to the print run.

Example 3

1. Preparation of printing Plate

A third sample lithographic printing plate was prepared in a vacuum roll coater instead of the box coater as demonstrated in Examples 1–2. In this method of preparing plates, a roll of 7 mil PET (ICI 453) film measuring 12"×300' was placed on the onwind roll and was sputter coated with titanium to form an absorption layer having a thickness of about 200 Å. An N-vinyl pyrrolidone monomer having a thickness of about 5000 Å was then evaporated onto the titanium absorption layer and cross-linked by electron beam curing to form a polymeric layer.

2. Imaging

Imaging of the third sample lithographic printing plate was carried out in the same manner as described in the test pattern of Example 1.

3. Printing

Printing with the third sample lithographic printing plate showed the two point courier font of the alphabet to print clearly with no dropouts or smears. The blacks were solid black and the white areas were the original color of the printing paper (i.e., the same white exhibited by unblemished printing paper).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A lithographic printing plate directly imageable by laser discharge, the printing plate comprises:

(a) a vacuum evaporated polymeric layer having a thickness of less than about 1000 Angstroms.

(b) an absorbing layer underlying the polymeric layer that absorbs infrared radiation; and (c) a substrate underlying the absorbing layer, wherein the polymeric layer and the substrate exhibit different affinities for at least one printing liquid selected from the group consisting of ink and an adhesive fluid for ink.

2. A lithographic printing plate directly imageable by laser discharge as recited in claim 1, wherein the polymeric layer comprises a hydrophilic polymer.

3. A lithographic printing plate directly imageable by laser discharge as recited in claim 1, wherein the thickness of the polymeric layer is about 200 to less than about 1000 Angstroms.

4. A lithography printing plate directly imageable by laser discharge as recited in claim 1, wherein the polymeric layer is selected from the group consisting of fluorinated ethylenepropylene, tetrafluoroethylene, and mixtures or derivatives thereof.

5. A lithographic printing plate directly imageable by laser discharge as recited in claim 1, wherein the polymeric layer comprises polyvinylpyrrolidone.

6. A lithographic printing plate directly imageable by laser discharge as recited in claim 1, wherein the polymeric layer comprises a cross-linked vacuum-evaporated hydrophilic polymeric layer.

7. A lithographic printing plate directly imageable by laser discharge as recited in claim 1, wherein the substrate is oleophilic.

8. A lithographic printing plate directly imageable by laser discharge as recited in claim 1, wherein the polymeric layer comprises a polymer selected from the group consisting of poly(2-hydroxyethylmethacrylate), polyethylene glycol, polyethylene oxide, ethylene glycol dimethacrylate, a copolymer of vinyl pyrrolidone and an acrylate, a copolymer of acrylic acid and an acrylate, a copolymer of acrylic acid, vinyl pyrrolidone and an acrylate, a copolymer of trimethanoltriacrylate and vinyl pyrrolidone, and mixtures and derivatives thereof.

9. A lithographic printing plate directly imageable by laser discharge as recited in claim 1, wherein the absorbing layer has a thickness of about 100 to about 500 Angstroms.

10. A lithographic printing plate directly imageable by laser discharge, the printing plate comprising:

(a) a polymeric layer comprising vacuum evaporated polyvinylpyrrolidone, the polymeric layer having a thickness of less than about 1000 Angstroms;

(b) an absorbing layer underlying the polymeric layer that absorbs infrared radiation, the absorbing layer having a thickness of about 100 to about 500 Angstroms; and (c) a substrate underlying the absorbing layer, wherein the polymeric layer and the substrate exhibit different affinities for at least one printing liquid selected from the group consisting of ink and an adhesive fluid for ink.

11. A lithographic printing plate directly imageable by laser discharge as recited in claim 10, wherein the thickness of the polymeric layer is about 200 to less than about 1000 Angstroms.

12. A lithographic printing plate directly imageable by laser discharge as recited in claim 10, wherein the polymeric layer is cross-linked.

13. A lithographic printing plate directly imageableby laser discharge as recited in claim 10, wherein the polymeric layer is an ion-treated polymeric layer that has been exposed to ions selected from the group consisting of $Ar^+$, $N_2^+$, and $O_2^+$.

14. A lithographic printing plate directly imageable by laser discharge as recited in claim 10, wherein the polymeric layer is a plasma-treated polymeric layer.

15. A lithographic printing plate directly imageable by laser discharge as recited in claim 14, wherein the plasma-treated polymeric layer has been exposed to a plasma selected from the group consisting of oxygen gas plasma, argon gas plasma, and nitrogen gas plasma.

16. A lithographic printing plate directly imageable by laser discharge as recited in claim 10, wherein the absorbing layer comprises titanium, a polymeric coating that absorbs infrared radiation, or a polymeric coating having a material therein that absorbs infrared radiation.

17. A lithographic printing plate directly imageable by laser discharge as recited in claim 10, wherein the absorbing layer comprises titanium.

18. A lithographic printing plate directly imageable by laser discharge as recited in claim 10, wherein the absorbing layer has a thickness of about 200 Angstroms.

19. A lithographic printing plate directly imageable by laser discharge as recited in claim 10, wherein the thickness of the polymeric layer is about 400 to less than about 1000 Angstroms.

20. A lithographic printing plate directly imageable by laser discharge as recited in claim 10, wherein the substrate comprises a material selected from the group consisting of paper, aluminum foil, aluminum plate, copper foil, copper plate, polycarbonate, polyester, polyimides, polyvinyl chloride, and mixtures or derivatives thereof.

21. A lithographic printing plate directly imageable by laser discharge as recited in claim 10, wherein the substrate comprises a material that is volatile when exposed to heat generated during absorption of infrared radiation in the absorbing layer.

22. A lithographic printing plate directly imageable by laser discharge as recited in claim 10, wherein the substrate comprises polyester.

23. A lithographic printing plate directly imageable by laser discharge as recited in claim 10, wherein the substrate comprises:

a volatile layer underlying the absorbing layer; and a material underlying the volatile layer, said volatile layer being volatile when exposed to heat generated during absorption of laser energy in the absorbing layer.

24. A lithographic printing plate directly imageable by laser discharge as recited in claim 23, wherein the volatile layer is selected from the group consisting of polyethylene carbonate, polyvinyl chloride, polyvinylidene, polyester, and mixtures or derivatives thereof.

25. A lithographic printing plate directly imageable by laser discharge as recited in claim 23, wherein the volatile layer is oleophilic.

26. A lithographic printing plate directly imageable by laser discharge, the printing plate comprising:

(a) a cross-linked hydrophilic polymeric layer, the polymeric layer having a thickness of less than about 1000 Angstroms and comprising a copolymer selected from the group consisting of a copolymer of pyrrolidone and an acrylate, a copolymer of acrylic acid and an acrylate, and a copolymer of acrylic acid, vinyl pyrrolidone and an acrylate;

(b) an absorbing layer underlying the polymeric layer that absorbs infrared radiation, the absorbing layer having a thickness of about 100 to about 500 Angstroms; and (c) a substrate underlying the absorbing layer, wherein the polymeric layer and the substrate exhibit different affinities for at least one printing liquid selected from the group consisting of ink and an adhesive fluid for ink.

27. A method of forming a lithographic printing plate directly imageable by laser discharge, the method comprising:

(a) providing a substrate;

(b) depositing an absorbing layer on the substrate that absorbs infrared radiation; and (c) vacuum evaporating a polymeric layer on the absorbing layer, the polymeric layer having a thickness of less than about 1000 Angstroms, wherein the polymeric layer and the substrate exhibit different affinities for at least one printing liquid selected from the group consisting of ink and an adhesive fluid for ink.

28. A method as recited in claim 27, wherein the polymeric layer comprises a hydrophilic polymer.

29. A method as recited in claim 27, wherein the polymeric layer comprises polyvinylpyrrolidone.

30. A method as recited in claim 27, wherein the absorbing layer has a thickness of about 100 to about 500 Angstroms.

31. A method as recited in claim 27, wherein the polymeric layer is cross-linked.

32. A method as recited in claim 27, further comprising:

providing at least one laser source capable of producing an imaging output a distance from the printing plate;

guiding the output of each laser to focus on the absorbing layer, wherein the absorbing layer absorbs infrared radiation;

causing relative movement between the laser output and the printing plate to effect a scan of the printing plate by the laser output; and selectively exposing, in a pattern representing the image, the printing plate to the laser output during the course of the scan so as to remove the polymeric layer and the absorbing layer to produce an image.

33. A method for imaging a lithographic printing plate, the method comprising the steps of:

(a) providing a printing plate comprising:

(i) a cross-linked vacuum evaporated polymeric layer comprising polyvinylpyrrolidone, the polymeric layer having a thickness of less than about 1000 Angstroms;

(ii) an absorbing layer underlying the polymeric layer that absorbs infrared radiation; and (iii) a substrate underlying the absorbing layer, the substrate comprising a material that is volatile when exposed to heat generated during absorption of infrared radiation in the absorbing layer;

wherein the polymeric layer and the substrate exhibit different affinities for at least one printing liquid selected from the group consisting of ink and an adhesive fluid for ink;

(b) providing at least one laser source a distance from the printing plate, the laser source capable of producing an imaging output of infrared radiation;

(c) guiding the imaging output to focus on the absorbing layer such that the absorbing layer absorbs the infrared radiation;

(d) causing relative movement between the imaging output and the printing plate to effect a scan of the printing plate by the imaging output; and (e) selectively exposing, in a pattern representing an image, the printing plate to the imaging output during the course of the scan so as to selectively remove the polymeric layer and the absorbing layer to produce the image.

34. A method as recited in claim 33, wherein the absorbing layer has a thickness of about 100 to about 500 Angstroms.

35. A method as recited in claim 33, wherein the selectively exposing step removes the polymeric layer and the absorbing layer sufficiently such that no cleaning step is required to remove remaining polymeric layer and absorbing layer material prior to use of the printing plate.

36. A method of printing with a printing press having a printing plate, the method comprising the steps of:

(a) providing a printing plate comprising:

(i) a cross-linked vacuum evaporated polymeric layer comprising polyvinylpyrrolidone, the polymeric layer having a thickness of less than about 1000 Angstroms;

(ii) an absorbing layer underlying the polymeric layer that absorbs infrared radiation, the absorbing layer having a thickness of about 100 to about 500 Angstroms; and (iii) a substrate underlying the absorbing layer, the substrate comprising a material that is volatile when exposed to heat generated during absorption of infrared radiation in the absorbing layer;

wherein the polymeric layer and the substrate exhibit different affinities for at least one printing liquid selected from the group consisting of ink and an adhesive fluid for ink;

(b) mounting the printing plate to the printing press;

(c) providing at least one laser source positioned a distance from the printing plate, the laser source capable of producing an imaging output of infrared radiation;

(d) guiding the imaging output to focus on the absorbing layer such that the absorbing layer absorbs the infrared radiation;

(e) causing relative movement between the imaging output and the printing plate to effect a scan of the printing plate by the imaging output;

(f) selectively exposing, in a pattern representing an image, the printing plate to the imaging output during the course of the scan so as to selectively remove the polymeric layer and the absorbing layer to produce the image;

(g) applying ink to the printing plate; and (h) transferring the ink to a recording medium.

37. A method for printing as recited in claim 36, further comprising the step of applying an adhesive fluid to the printing plate after the step of selectively exposing the printing plate to the imaging output, and before applying the ink to the printing plate, wherein the adhesive fluid adheres to the cross-linked polymeric layer.

38. A lithographic printing plate directly imageable by laser discharge, the printing plate comprising:

(a) a polymeric layer having a thickness of less than about 1000 Angstroms and comprising a polymer selected from the group consisting of poly(2-hydroxyethylmethacrylate), polyethylene glycol, polyethylene oxide, ethylene glycol dimethacrylate, a copolymer of vinyl pyrrolidone and an acrylate, a copolymer of acrylic acid and an acrylate, a copolymer of acrylic acid, vinyl pyrrolidone and an acrylate, a copolymer of trimethanoltriacrylate and vinyl pyrrolidone, and mixtures or derivatives thereof;

(b) an absorbing layer underlying the polymeric layer that absorbs infrared radiation; and (c) a substrate underlying the absorbing layer, wherein the polymeric layer and the substrate exhibit different affinities for at least one printing liquid selected from the group consisting of ink and an adhesive fluid for ink.

* * * * *

UNITED STATES PATENT AND TRADEMARK OFFICE

CERTIFICATE OF CORRECTION

PATENT NO. : 6,105,501
DATED : August 22, 2000
INVENTOR(S) : Phillips et al.

It is certified that error appears in the above-identified patent and that said Letters Patent is hereby corrected as shown below:

Title page, item [57]

Please replace the word "adhesive" with the word -- abhesive -- where it appears as noted below:

in the last line of the abstract; in column 1, line 24; in column 2, line 14; in column 2, line 25; in column 3 line 25; in column 6, line 6; in column 6, line 37; in column 6, line 38; in column 6, line 42; in column 8, line 60; in column 9, line 62; in column 10, line 51; in column 11, line 50 (two occurrences); in column 11, line 51; in column 13, line 57; in column 14, line 35; in column 15, line 47; in column 15, line 60; in column 16, line 32; in column 17, line 6; in column 17, line 26; in column 18, line 3; and in column 18, line 23.

Signed and Sealed this

First Day of May, 2001

Nicholas P. Godici

*Attest:*

NICHOLAS P. GODICI

*Attesting Officer*

*Acting Director of the United States Patent and Trademark Office*